US006179273B1

(12) United States Patent
Edmunds, III et al.

(10) Patent No.: US 6,179,273 B1
(45) **Date of Patent: *Jan. 30, 2001**

(54) INJECTION-MOLDED BLOCK-OUT SPACER

(75) Inventors: Edward Edmunds, III; James Rutherford, both of El Paso, TX (US)

(73) Assignee: Highway Plastics, LLC, El Paso, TX (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/267,374

(22) Filed: Mar. 15, 1999

(51) Int. Cl.[7] ..... A01K 3/00

(52) U.S. Cl. ..... 256/13.1; 256/65; 256/19; 404/6

(58) Field of Search ..... 256/131, 1, 65, 256/66, 19; 404/6, 7, 8, 9; 248/345.1

(56) References Cited

U.S. PATENT DOCUMENTS

| | | | | |
|---|---|---|---|---|
| 2,123,414 | | 7/1938 | Gilmore | 250/33 |
| 3,975,068 | | 8/1976 | Speckin | 312/254 |
| 4,329,800 | | 5/1982 | Shuman | 40/606 |
| 5,078,538 | * | 1/1992 | Montalbano | 404/9 |
| 5,195,727 | * | 3/1993 | Liao et al. | 256/13.1 |
| 5,197,819 | | 3/1993 | Hughes | 404/13 |
| 5,601,279 | * | 2/1997 | Schwartz et al. | 256/66 |
| 5,657,966 | * | 8/1997 | Cicinnati | 256/13.1 |
| 5,667,335 | * | 9/1997 | Khieu et al. | 404/9 X |
| 5,727,762 | | 3/1998 | Cosentino | 248/231.61 |
| 5,794,897 | | 8/1998 | Jobin et al. | 248/74.4 |
| 5,902,067 | * | 5/1999 | Rushing | 256/13.1 X |
| 6,007,269 | * | 5/1999 | Marinelli | 256/13.1 X |

* cited by examiner

*Primary Examiner*—Lynne H. Browne
*Assistant Examiner*—John R. Cottingham
(74) *Attorney, Agent, or Firm*—Morgan, Lewis & Bockius LLP

(57) ABSTRACT

A spacer is shown for spacing a post from a rail used alongside a road. The spacer is formed from an injection-molded plastic honeycomb structure. The honeycomb structure has a number of substantially parallel, internal webs, with the internal webs extending in a direction substantially perpendicular to the post and the rail. The spacer can be formed with a post-interfacing side of the spacer having a stepped configuration that allows the spacer to engage with a variety of different shaped posts. Each of the substantially parallel internal webs of the spacer is provided with the stepped configuration at the post-interfacing end of each of the webs. A width of the bottom surface of the stepped surface is selected for engagement with a standard width flange on an I-beam type post. A width of an intermediate ledge surface on the stepped surface is selected for engagement with standard wooden square posts. The stepped surface is also provided with chamfered surfaces that fall along a locus of points having a radius approximately equal to the outer radius of a standard round wooden post. The spacer also has an internal partition extending between the post-interfacing side and the rail-interfacing side of the spacer and defining an opening through which a connector can be passed. The internal partition can be offset relative to a central longitudinal axis of the spacer so that a connector passing through the opening will not interfere with the central web of an I-beam type spacer.

15 Claims, 5 Drawing Sheets

INJECTION-MOLDED BLOCK-OUT SPACER

BACKGROUND OF THE INVENTION

1. Field of the Invention

This invention relates to a road barrier, and more particularly, to the connecting element or spacer positioned between the posts and the guardrail running alongside a road.

2. Description of the Related Art

Conventional road barriers include wooden or I-beam-type posts placed in the ground at spaced locations alongside a road and a metal guardrail connected to and spaced from the posts. A connecting element or spacer, generally referred to as a "block-out", is fitted between the posts and the guardrail. Conventional block-outs are made of treated wood or extruded metal.

Conventional posts used with road barriers include sections of I-beams and round wooden posts. Guardrails are generally formed from metal. A problem with conventional road barriers is that different block-outs must be provided depending on whether the round wooden posts or the I-beam-type posts are used. A block-out used with round wooden posts should be provided with a curved post-interfacing surface for engagement with a portion of the outer circumference of the post. Block-outs used with I-beam-type posts should be provided with a post-interfacing surface that conforms to a flange of the I-beam.

Another problem with conventional road barriers is that the wooden block-outs must be treated with preservatives to withstand deterioration resulting from environmental conditions. The preservatives used for treating the wooden block-outs are generally hazardous chemicals that present problems of handling and disposal. Another problem with conventional wooden block-outs is that they often crack and splinter over time as a result of exposure to moisture and changes in temperature. The hazardous materials used to preserve conventional wooden block-outs and their tendency to splinter makes handling of the conventional wooden block-outs hazardous and increases the chance that workman's compensation claims will be filed by those handling the conventional block-outs.

SUMMARY OF THE INVENTION

The present invention has been made in view of the above circumstances and has as an object to produce an economical, environmentally safe and versatile block-out for connecting and spacing a post from a guardrail used in road barriers alongside a road.

It is a further object of the invention to produce a block-out for use between a post and a guardrail that can be readily mass-produced and that will fit a variety of conventional posts.

Yet another object of the invention is to produce a block-out for use between a post and a guardrail that can be made from various types of recycled materials.

Additional objects and advantages of the invention will be set forth in part in the description which follows, and in part will be obvious from the description or may be learned by practice of the invention. The objects and advantages of the invention will be realized and attained by means of the elements and combinations particularly pointed out in the appended claims.

To achieve the objects in accordance with the purpose of the invention, as embodied and broadly described herein, the invention includes a conventional post, a conventional guardrail, and a connecting element between the post and the guardrail, with the connecting element being formed from injection-molded plastic and including at least one internal web extending substantially parallel to a line between the post and the guardrail.

The invention also includes the connecting element having a post-interfacing side and an opposite rail-interfacing side, with an elongated hole being defined through the connecting element between the post-interfacing side and the rail-interfacing side to allow passage of a connector extending from the post to the guardrail.

The invention further includes the post-interfacing side of the connecting element or spacer having a stepped surface. The stepped surface of the post-interfacing side has a bottom surface with two ends separated by a first width, an intermediate ledge surface spaced above the bottom surface and extending outwardly beyond both ends of the bottom surface to a second width greater than the first width, and a top surface spaced above the intermediate ledge surface. The inside corners of the intermediate ledge surface and of the top surface are chamfered and lie along a locus of points having a radius approximately equal to a radius of the outer surface of a round post. The first width of the bottom surface is selected so that a standard flange on an I-beam-type post will fit on the bottom surface. The chamfered inside corners of the top surface and the intermediate ledge surface are selected to fit the outer circumference of a conventional round wooden post.

The invention also includes the connecting element or spacer being an injection-molded plastic honeycomb structure having a plurality of substantially parallel internal webs, with the internal webs extending in a direction substantially perpendicular to the post and the guard rail (or substantially parallel to a line extending between the post and the guardrail). Each of the substantially parallel internal webs is provided with a stepped surface on the post-interfacing side of the honeycomb structure. In addition, at least one of the internal webs is connected to an internal partition extending from the post-interfacing side to the rail-interfacing side. The internal partition defines an elongated hole through the spacer for passage of a connector extending between the post and the guardrail.

The stepped surfaces on the post-interfacing sides of each of the substantially parallel internal webs are aligned with each other to form the stepped surface of the post-interfacing side that will engage with a variety of different posts.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention.

DESCRIPTION OF THE PREFERRED EMBODIMENT

Reference will now be made in detail to the present exemplary embodiments of the invention illustrated in the accompanying drawings. Wherever possible, the same reference numbers will be used throughout the drawings to refer to the same or like parts.

Figure 1:
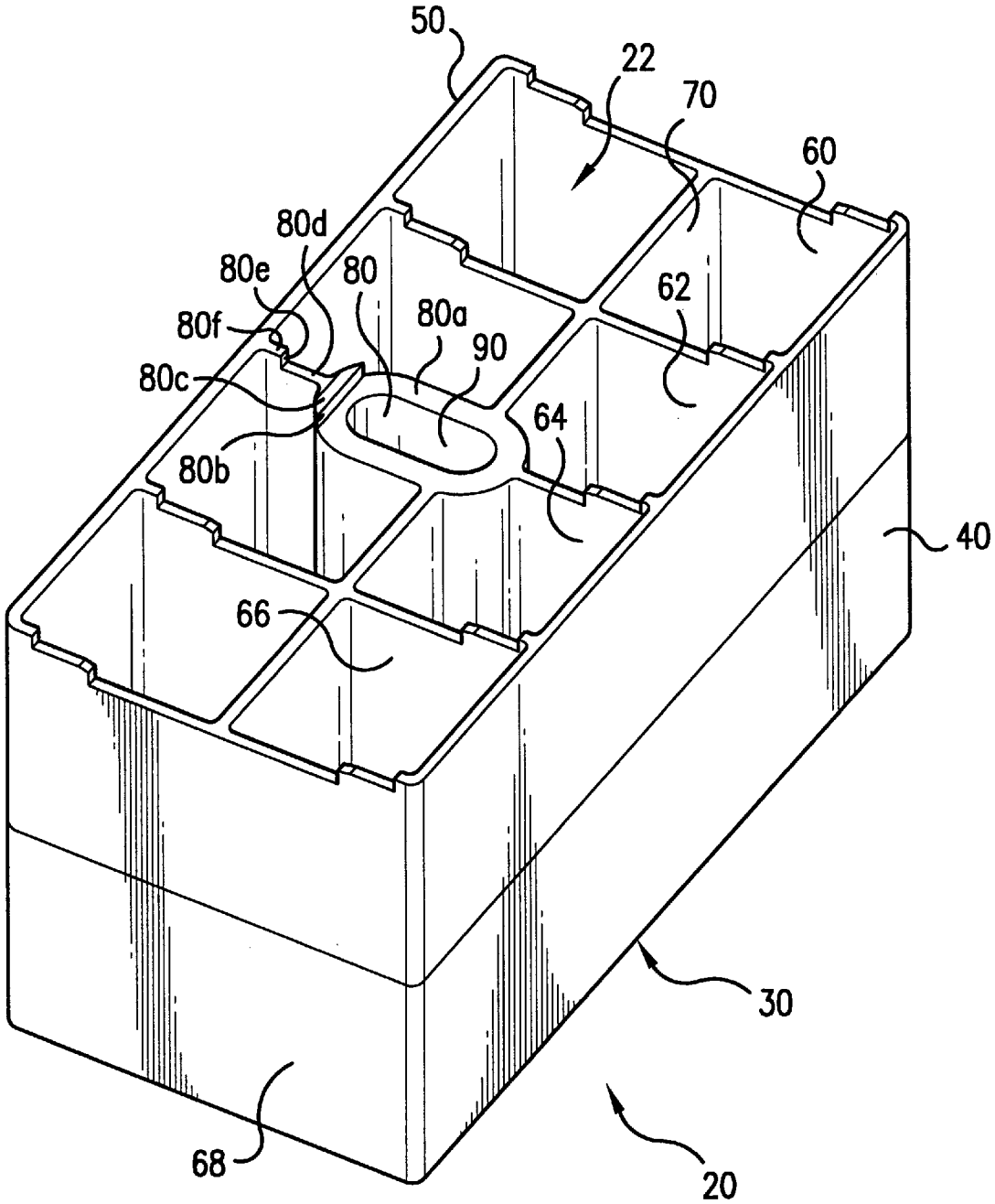
FIG. 1 illustrates a perspective view of a first embodiment of the invention.

FIG. 1 shows a first embodiment of the invention. The spacer 20 (commonly referred to as a "block-out") for spacing a post from a guardrail used alongside a road is formed as an injection-molded honeycomb structure. A variety of different plastic or other elastomeric materials can be used to form the injection-molded structure, including recycled, post-consumer, scrap products. The honeycomb structure includes two opposite, substantially parallel sidewalls 40 and 50. The sidewalls 40, 50 are connected by a series of substantially parallel internal webs 60, 62, 64, 66, and 68. An internal, longitudinally-extending web 70 interconnects the transversely-extending webs 60, 62, 64, 66, and 68, and extends in substantially parallel relationship to the outer sidewalls 40, 50.

An internal, oval-shaped partition 80 is also molded integrally with at least one of the transversely-extending internal webs and longitudinal web 70. An artisan will recognize that the exact number of transversely-extending and longitudinally-extending webs can be varied. The thicknesses of the internal webs and the number of internal webs is selected in order to withstand the desired amount of compression loading exerted on the spacer when a vehicle collides with the guardrail attached to the spacer or block-out.

Figure 5:
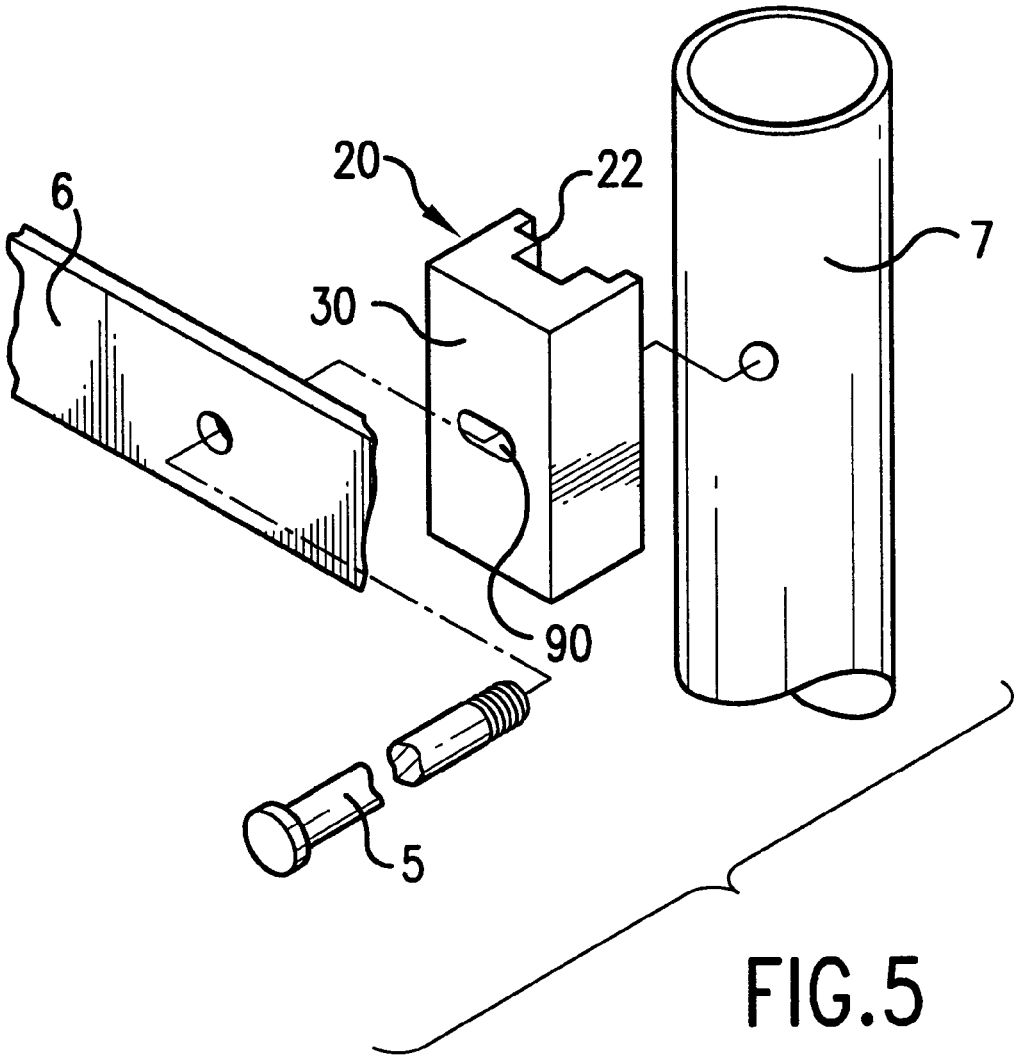
FIG. 5 illustrates an exploded view of the assembly of an embodiment of the block-out spacer between a guardrail and a post.

In the embodiment shown in FIG. 1, and FIG. 5 the bottom side 30 of the spacer 20 forms a guardrail-interfacing side of the spacer, and the top side 22 of the spacer 20 forms a post-interfacing side of the spacer. An opening 90 defined by the oval-shaped internal partition 80 allows for the passage of a connector 5 between a guardrail 6 on the rail-interfacing side 30 and a post 7 on the post-interfacing side 22. The opening 90 can be offset relative to a central longitudinal axis of the spacer 20 as shown in FIG. 1. The offset of the hole 90 allows a connector to be passed between an I-beam-type post and the guardrail without interfering with the central web on the I-beam.

Conventional posts including round wooden posts, square wooden posts, and I-beam-type posts can be engaged with the post-interfacing side 22 of the spacer 20. The post-interfacing side 22 is provided with a stepped surface designed to mate with either round posts or posts having flat surfaces on their outer periphery. The stepped surface on the post-interfacing end of web 60 is described in detail below. The description pertains to the stepped surfaces on the post-interfacing ends of each of the webs 60, 62, 64, 66, and 68.

Figure 2:
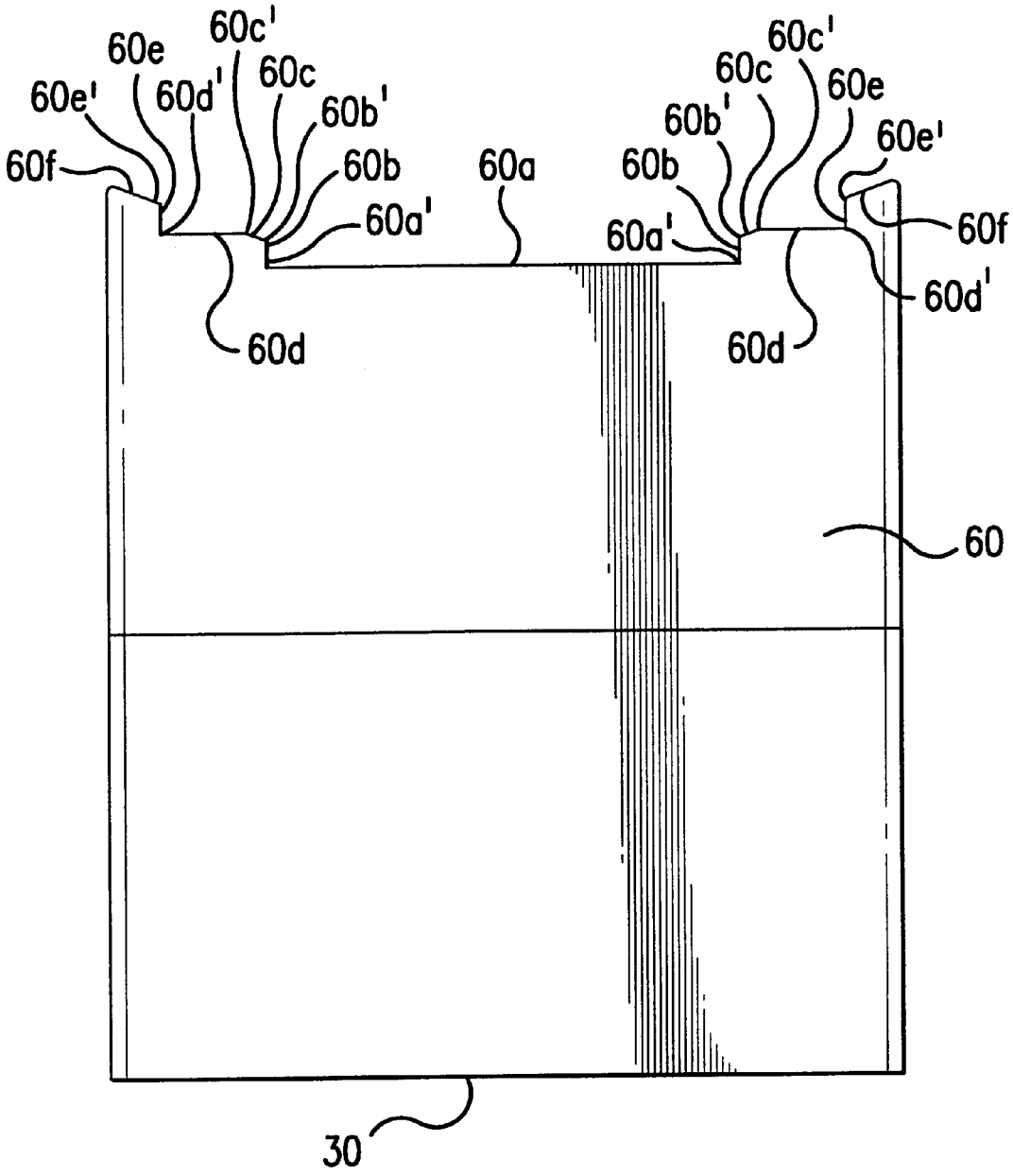
FIG. 2 illustrates a side view of the embodiment shown in FIG. 1.

As best seen in FIG. 2, a centrally-disposed bottom surface 60*a* extends equidistance from both sides of a central axis of the spacer 20 to a first width, and is spaced a first distance below a top surface of the post-interfacing side 22. Opposite ends 60*a*' of bottom surface 60*a* intersect with surfaces 60*b* that extend substantially perpendicular to the bottom surface 60*a*. Surfaces 60*b* extend upwardly from bottom surface 60*a* to corners 60*b*' at the intersection with chamfered surfaces 60*c*.

As will be described in more detail below, the chamfered surfaces 60*c* lie along a locus of points having a radius approximately equal to the outer radius of a post to be engaged with the post-interfacing surface 22. Chamfered surfaces 60*c* terminate at corners 60*c*' with intermediate ledge surfaces 60*d*. The intermediate ledge surfaces 60*d* extend outwardly beyond the ends 60*a*' of bottom surface 60*a* to a second width that is greater than the first width of the bottom surface 60*a*. Intermediate ledge surfaces 60*d* intersect at corners 60*d*' with surfaces 60*e* that extend upwardly and perpendicular to the intermediate ledge surfaces 60*d* and bottom surface 60*a*. The surfaces 60*e* terminate at corners 60*e*' with top surfaces 60*f*. Top surfaces 60*f* are chamfered similarly to chamfered surfaces 60*c* to fall along a locus of points having approximately the same radius as the outer radius of a conventional round, wooden post. When the above-described stepped surface is engaged with a round post, the round post rests on chamfered surfaces 60*f* and 60*c* as well as engaging tangentially with bottom surface 60*a*. The width of bottom surface 60*a* between corners 60*a*' is also selected to be slightly larger than the width of an I-beam flange on an I-beam-type post.

Intermediate ledge surfaces 60*d*extend out to a second width between ends 60*d*' that is greater than the width of bottom surface 60*a* and that is sufficient to fit the standard width of a conventional square wooden post. The stepped surfaces on the post-interfacing side 22 are substantially identical on each of the internal webs 60, 62, 64, 66, and 68. The stepped surfaces are also aligned with each other in a longitudinal direction of the spacer 20 such that the spacer 20 can fit a variety of standard posts including a four inch I-beam post, a 6 inch wooden square post, and an 8 inch round wooden post. An artisan will recognize that the dimensions of the stepped surfaces can be varied if necessary to fit other shapes or sizes of posts. A significant advantage of providing a stepped surface is that it allows one spacer to conform to a variety of different shaped and size posts.

The oval-shaped internal partition 80 extending between the post-interfacing side 22 and the rail-interfacing side 30 is offset in a transverse direction relative to central, longitudinally-extending web 70. As a result, when an I-beam type post is engaged with bottom surface 60*a*, the central web of the I-beam type post will not interfere with a bolt passing through the opening 90 between the post and the rail.

In the embodiment shown in FIG. 1, internal partition 80 is offset from a central longitudinal axis through web 70 toward side 50 of the spacer 20. As a result of this offset towards side 50, only one side of the internal partition 80 has a stepped configuration that aligns with the stepped surfaces on the other internal webs. Similarly to the stepped surfaces on the other internal webs, internal partition 80 includes a bottom surface 80*a*, surface 80*b* extending upwardly from and substantially perpendicular to the bottom surface 80*a*, chamfered surface 80*c* for engagement with a round post, intermediate ledge surface 80*d*, surface 80*e* extending upwardly from intermediate ledge surface 80*d*, and a top chamfered surface 80*f* also for engagement with the round post. An artisan will recognize that the internal partition 80 could be offset toward either side 50 or 40 in order to provide an opening 90 through which a connector can be passed without interfering with the central web on an I-beam type post.

Figure 3:
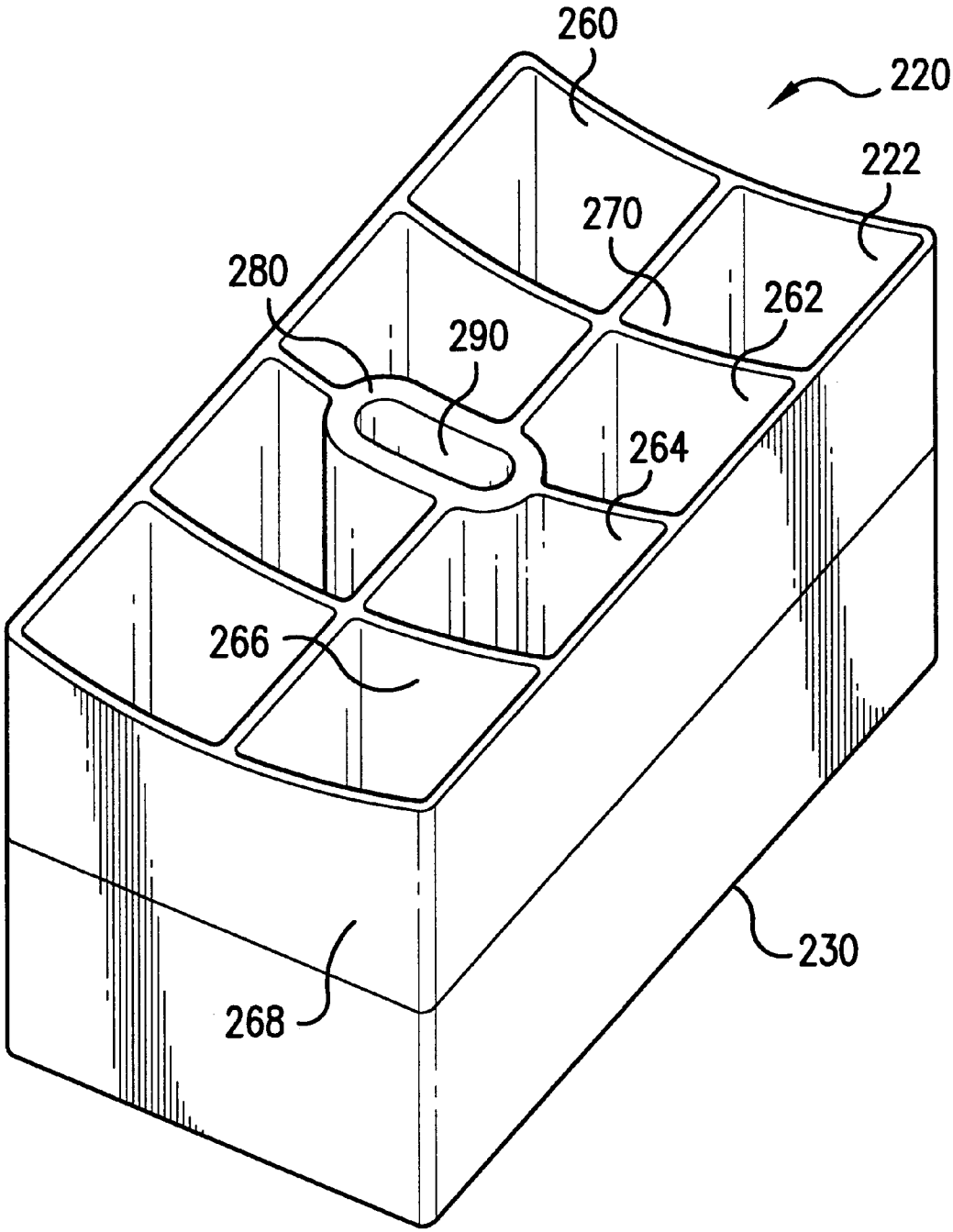
FIG. 3 illustrates a perspective view of a second embodiment of the invention.
Figure 4:
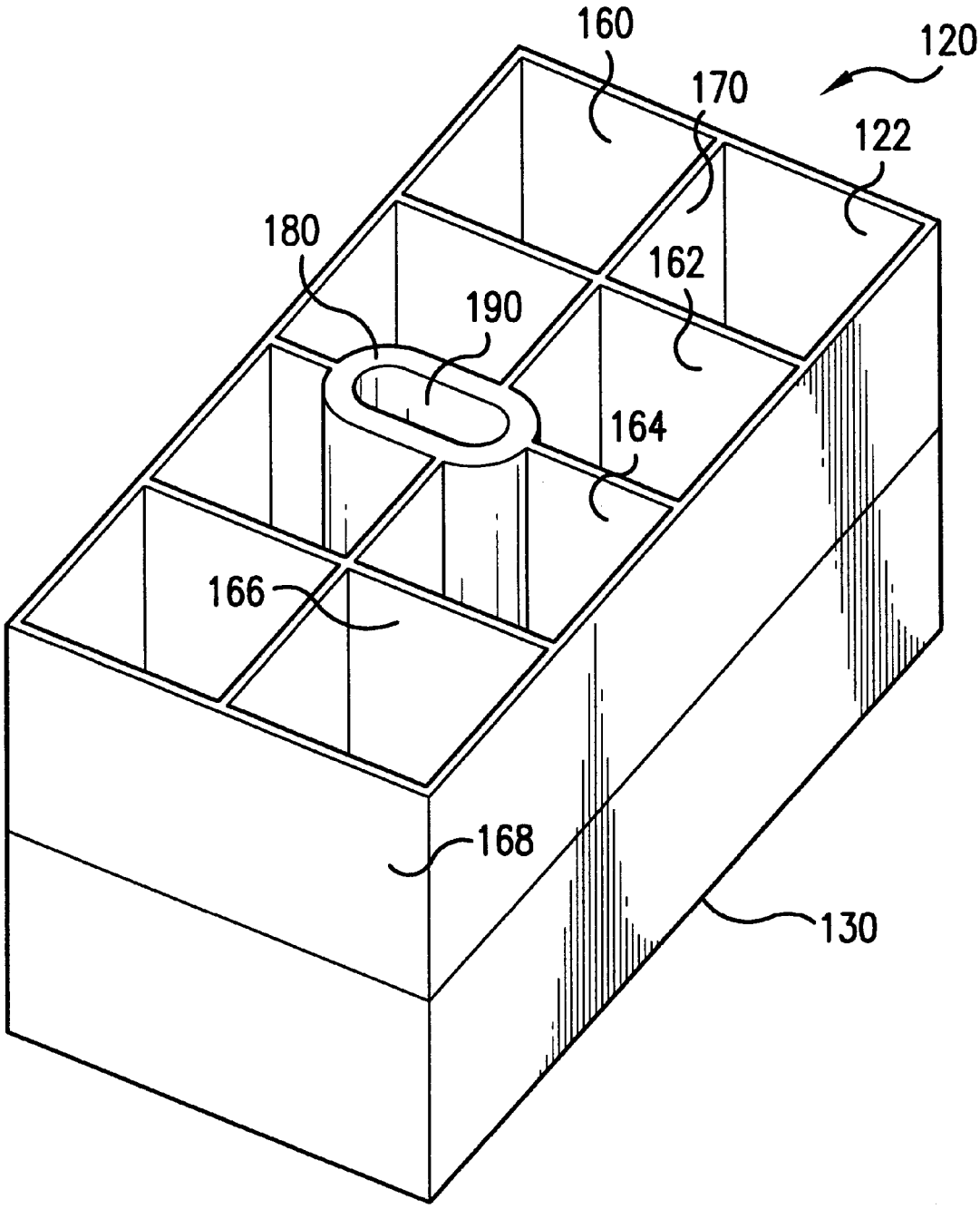
FIG. 4 illustrates a perspective view of a third embodiment of the invention.

Alternative embodiments of this spacer are shown in FIGS. 3 and 4. A flat-type spacer 120, shown in FIG. 4, is provided with a flat post-interfacing surface 122 for engagement with square or rectangular wooden posts. The flat-type spacer 120 is formed with an injection-molded honeycomb structure. The internal partition 180 for flat-type spacer 120 is in the shape of a cylinder centered on a central axis of the spacer 120 and passing between the post-interfacing surface 122 and the rail-interfacing surface 130. Internal transverse webs 160, 162, 164, 166, 15 and 168, and longitudinal web 170 extend substantially perpendicular to post-interfacing surface 122 and rail-interfacing surface 130.

A radius-type spacer 220 is shown in FIG. 3. Similarly to the first two embodiments, the radius-type spacer is formed as an injection-molded honeycomb structure. The post-interfacing surface 222 of the radius-type spacer 220 is provided with a radius to mate with a conventional round wooden post. The internal partition 280 is also a cylindrically-shaped partition extending between post-interfacing side 222 and rail-interfacing side 230. Transverse internal webs 260, 262, 264, 266, and 268, and longitudinal web 270 extend substantially perpendicular to the post-interfacing side 222 and the rail-interfacing side 230.

In both the second and third embodiments described above, the centrally disposed internal partitions 180 and 280 define openings 190 and 290, respectively, passing through the central axis of the spacers. Accordingly, neither the second nor the third embodiments lend themselves to use with an I-beam-type post having a central web.

It will be apparent to those skilled in the art that various modifications and variations can be made without departing from the scope or spirit of the invention. Other embodiments of the invention will be apparent to those skilled in the art from consideration of the specification and practice of the invention disclosed herein. It is intended that the specification and examples be considered as exemplary only, with a true scope and the spirit of the invention being indicated by the following claims.

What is claimed is:

1. A road barrier, comprising:

a substantially vertical post;

a substantially horizontal rail;

a connecting element between said post and said rail, said connecting element being injection-molded plastic and including opposite side walls and a first internal web extending between said side walls and substantially parallel to a line between said post and said rail; and a plurality of internal webs extending parallel to said first internal web, said internal webs extending between a post-interfacing side of said connecting element and a rail-interfacing side of said connecting element and said internal webs each being formed with a stepped surface on said post-interfacing side.

2. The road barrier according to claim 1, wherein an elongated hole is defined through said connecting element between said post-interfacing side and said rail-interfacing side to allow passage of a connector extending from said post to said rail.

3. The road barrier according to claim 2, wherein said post-interfacing side includes a stepped surface.

4. The road barrier according to claim 3, wherein said stepped surface includes a bottom surface having two ends separated by a first width; an intermediate ledge surface spaced above said bottom surface and extending outwardly beyond both ends of said bottom surface to a second width greater than said first width; and a top surface spaced above said intermediate ledge surface.

5. The road barrier according to claim 4, wherein inside corners of said intermediate ledge surface and said top surface, and a point on said bottom surface fall on a locus of points having a radius substantially equal to an outer radius of said post.

6. The road barrier according to claim 1, wherein said stepped surfaces of said internal webs each include a recessed bottom surface having a first width at a first depth below a top surface of said post-interfacing side, and ledge surfaces extending to a second width greater than said first width on both sides of said bottom surface and at a second depth below said top surface that is less than said first depth.

7. The road barrier according to claim 6, wherein inside corners of said ledge surfaces on each stepped surface and inside corners of said top surface on each stepped surface fall on a locus of points having a radius approximately equal to an outer radius of the post.

8. The road barrier according to claim 6, wherein said post has an I-beam configuration and a flange of said post fits in the recessed bottom surface.

9. The road barrier according to claim 6, wherein said post is a parallelepiped and an outer surface of said post fits on said ledge surfaces and has a width approximately equal to said second width.

10. A road barrier, comprising:

a substantially vertical post;

a substantially horizontal rail; and a spacer for spacing the post from the rail used alongside a road, said spacer comprising:

an injection-molded plastic honeycomb having opposite sidewalls and a plurality of substantially parallel, internal webs, said internal webs extending between said sidewalls and in a direction substantially perpendicular to the post and the rail and said internal webs each being formed with a stepped surface on a post-interfacing side of said spacer.

11. The spacer according to claim 10, wherein the post-interfacing side of said spacer is shaped for engagement with the post and an opposite rail-interfacing side of said spacer is shaped for engagement with the rail, at least one of said internal webs is connected to an internal partition extending from said post-interfacing side to said rail-interfacing side, said internal partition defining an elongated hole through said spacer for passage of a connector extending between the post and the rail.

12. The spacer according to claim 11, wherein said post-interfacing side includes a stepped surface.

13. The spacer according to claim 12, wherein a central axis of said elongated hole is offset relative to a central axis of said spacer.

14. The spacer according to claim 13, wherein said stepped surface includes a bottom surface having two ends separated by a first width, an intermediate ledge surface spaced above said bottom surface and extending outwardly beyond both ends of said bottom surface to a second width greater than said first width, and a top surface spaced above said intermediate ledge surface.

15. The spacer according to claim 14, wherein said intermediate ledge surface and said top surface are chamfered at inside corners to form a contoured, post-seating surface with said chamfered inside corners lying on a radius approximately equal to the outer radius of the post.

* * * * *